US006715456B2

(12) United States Patent
Wurms et al.

(10) Patent No.: US 6,715,456 B2
(45) Date of Patent: Apr. 6, 2004

(54) VARIABLE VALVE CONTROL COMPRISING A SLIDING-BLOCK PART AND A FREE TRAVEL

(75) Inventors: Rainer Wurms, Lenting (DE); Stefan Dengler, Allersberg (DE)

(73) Assignee: Audi AG (DE)

( * ) Notice: Subject to any disclaimer, the term of this patent is extended or adjusted under 35 U.S.C. 154(b) by 0 days.

(21) Appl. No.: 10/221,311

(22) PCT Filed: Mar. 23, 2001

(86) PCT No.: PCT/EP01/03342

§ 371 (c)(1),
(2), (4) Date: Sep. 11, 2002

(87) PCT Pub. No.: WO01/75279

PCT Pub. Date: Oct. 11, 2001

(65) Prior Publication Data

US 2003/0037739 A1 Feb. 27, 2003

(30) Foreign Application Priority Data

Mar. 31, 2000 (DE) ..... 100 16 103

(51) Int. Cl.[7] ..... F01L 1/34

(52) U.S. Cl. ..... 123/90.16; 123/90.39; 123/90.17

(58) Field of Search ..... 123/90.16, 90.17, 123/90.39, 90.41, 90.44, 90.45; 74/559, 569

(56) References Cited

U.S. PATENT DOCUMENTS 4,138,973 A * 2/1979 Luria ..... 123/78 B
4,526,142 A * 7/1985 Hara et al. ..... 123/90.16
5,297,505 A * 3/1994 Doll et al. ..... 123/90.16
5,373,818 A 12/1994 Unger ..... 123/90.16
5,839,400 A * 11/1998 Vattaneo et al. ..... 123/90.16

FOREIGN PATENT DOCUMENTS

| | | |
|---|---|---|
| DE | 38 33 540 A1 | 4/1990 |
| DE | 41 35 257 C2 | 4/1993 |
| DE | 42 23 173 A1 | 1/1994 |
| DE | 43 13 656 A1 | 10/1994 |
| DE | 44 46 725 A1 | 1/1996 |
| DE | 197 01 203 A1 | 7/1998 |
| WO | WO 98/36157 | 8/1998 |

* cited by examiner

*Primary Examiner*—Thomas Denion
*Assistant Examiner*—Ching Chang
(74) *Attorney, Agent, or Firm*—Steven, Davis, Miller & Mosher, LLP

(57) ABSTRACT

The invention relates to a variable valve train for reciprocating engines, in particular internal combustion engines comprising at least one cam of a camshaft that is rotatably mounted in the cylinder head. Said cam actuates a lift valve using a pulley assembly which can be displaceably guided in a sliding-block part along an adjusting inclined plane, together with a valve actuating element which is connected in series. The valve stroke can be adjusted in a variable manner in relation to the cam by the displacement of the sliding-block part and the pulley assembly is elastically pre-tensioned in relation to the cam. To achieve a sturdy valve train which exhibits uniform valve accelerations, a free travel (s) that allows an excitation movement of the pulley assembly is provided between the cam heel and the valve actuating element. The valve actuating element is configured as a two-part cam follower with a rocker action and the sliding-block part has a sliding-block guide comprising an additional excitation inclined plane for the pulley assembly.

20 Claims, 4 Drawing Sheets

VARIABLE VALVE CONTROL COMPRISING A SLIDING-BLOCK PART AND A FREE TRAVEL

The invention relates to a variable valve control device for reciprocating engines, internal combustion engines in particular, as specified in the preamble of claim 1.

Such a variable valve control device is disclosed, for example, in DE 42 23 173 A1; it is a device in which an adjustable sliding block (rocker arm) element in the cylinder head of the internal combustion engine, with an inclined adjusting plane and a roller, is introduced between the cam of a camshaft on one side and the cup stem on the shaft end of an upper valve on the other side. Both a full stroke and partial strokes to around zero stroke can be controlled by displacement of the sliding block element relative to the cam. In the case of a full stroke such displacement results in valve actuation which with respect to valve lift and velocity profile development is determined by the geometry of the cam and the inclined adjusting plane and which may be correspondingly optimized. In the case of the partial stroke, of course, first an idle stroke (=excitation movement) is executed and then the partial stroke (=generation movement), a cam area exerting its effect later in time in this instance, an area which of necessity may cause a different velocity profile development or high, jerky valve accelerations. This applies both to valve opening (upward slope) and valve closing (downward slope).

The object of the invention is to create a generic variable valve control device which permits extensive valve stroke changes accompanied by valve actuation as free of jerkiness as possible and which is of rugged design and cost-effective in manufacture.

It is claimed for the invention that this object is attained by the features specified in claim 1. Advantageous developments of the invention are specified in the additional claims.

It is proposed in accordance with the invention that there be inserted between the cam and the valve actuation element, a valve rocker in particular, an empty run (free travel) component which effects preacceleration (excitation movement) of the sliding block in the case both of a full stroke and partial strokes of the upper valve, so that the generation movement (opening movement) of the upper valve is controlled with the positive and negative acceleration desired essentially by the inclined adjusting plane of the rocker arm element. This decoupling of excitation movement and generation movement executed by the geometric design of cam and variable valve control device creates a velocity profile without higher acceleration peaks and accordingly a rugged valve train which is improved from the viewpoint of wear and operating noise, to the greatest extent possible independently of the assigned valve travel.

The layout of the valve train as specified in claim 3 additionally permits longer valve strokes and accordingly a larger valve stroke adjustment range determined by a valve rocker having the associated more favorable rocker ratios and by the positioning of the inclined adjusting plane more or less perpendicular to the axis of rotation of the cam, which results in shorter lateral travel distances of the roll pack especially during excitation movement. In this situation the contact surface of the valve rocker for the roll pack may be oriented parallel to the direction of displacement of the rocker arm element.

In another advantageous embodiment of the invention the inclined adjusting plane of the rocker arm element is in the form of a slotted rocker arm guide whose opposite guide surface forms an inclined preacceleration plane in excitation movement of the sliding block element which provides smooth transition to the inclined contact plane section of the inclined adjusting plane for the movement of generation. This results in gentle sliding positioning of the sliding block element on the valve rocker followed by generation movement without a transitional element.

The sliding block element may advantageously be pretensioned against the cam by means of at least one simple spring clip. The spring clip may preferably be supported on the rocker arm element by one of its sides and acts in conjunction with a second, elongated side on the sliding block element pretensioning the latter against the cam.

In the case of use of a hydraulic valve play equalization element in the valve train in particular it may be advantageous for the valve rocker to rest against a stop of the rocker arm component when the upper valve is in the closed position. The pulley assembly may be lifted by the valve rocker as a result of pretensioning of the spring clip, so that constant contact is established between the sliding block element and the cam, and free play is established between the valve rocker, the rocker arm element, and the valve shaft.

In order to achieve a valve rocker structure which is rigid and produces high layout accuracy, preference is given to mounting the valve rocker in the cylinder head by way of one valve rocker axis. In this situation the hydraulic valve play equalization element could then be mounted on the end of the valve rocker operating in conjunction with the shaft end of the upper valve. It is proposed, however, that preference be given to a valve rocker in at least two parts, one part of which is pivotably mounted, while the other part resembling a rocker rests on one side on the hydraulic valve play equalization element and on the other on the shaft end of the upper valve, the two interposed valve rocker parts being connected to each other in operation (by means of a carrier extending transversely or by a pin joint connection).

One exemplary embodiment of the invention is explained in greater detail in what follows.

The drawing illustrates

In FIG. 1 a cross-section through a variable valve train in the cylinder head of a reciprocating internal combustion engine along line I—I of FIG. 2, with a cam, a movable rocker arm element, a sliding block element, and a valve rocker acting on an upper valve;

in FIG. 2 a view of the valve train along arrow X in FIG. 1;

in FIG. 3 a side view of the two-part valve rocker mounted between the rocker arm element and the upper valve;

in FIG. 4 a top view of the valve rocker shown in FIG. 3;

in FIG. 5 diagrams of the valve train in the case of a full stroke; and in FIG. 6 the same diagrams for a partial stroke of the upper valve.

In FIGS. 1 and 2, 10 designates a camshaft which is rotatably mounted in a cylinder head 12 (only part of which is shown) of a multiple-cylinder reciprocating internal combustion engine and which carries a cam 14 for actuation of intake upper valves, only one upper valve or its vertical shaft 16 being shown.

In order to obtain a variable valve train, a rocker arm component 18 is movably mounted by way of fitting bores (20) in the cylinder head 12 on stationary guide pins 22. The rocker arm component 18 may be adjusted in the direction of the double arrow 24 by means of an adjusting mechanism not shown (such as an eccentric shaft adjusted by hydraulic or electric means).

The more or less U-shaped rocker arm component 18 with a base wall 56 has in each of the lateral legs 26,28 a rocker arm guide with an inclined adjusting plane 30 and an inclined preacceleration plane 32.

A sliding block element 34 is inserted so as to be movable into the slotted rocker arm guide 30,32 open at the top. The sliding block element 34 has a central roller 34*a* (FIG. 2) which rolls on the cam 14. To the left and right of this element 34 two other rollers 34*b*,34*c* are provided which roll on the contact surfaces 36*a*,36*b* of a valve rocker 36, the rollers in question being mounted on roller bearings on a transfer pin 34*d* which operates in conjunction with the inclined planes 30,32 in question.

The valve rocker 36 is made up of a first H-shaped valve rocker component 40 and an interposed valve rocker component 42 which are mounted as follows.

The first valve rocker component 40 is one side mounted by way of mounting bores 44 on stationary valve rocker shafts 46 and carries the contact surfaces 36*a*,36*b* for the rollers 34*b*,34*c* of the sliding block element 34. In addition, the valve rocker component 40 has a carrier 48 extending transversely which acts on the interposed second valve rocker component 42 as a counterpoise.

The second valve rocker component 42 rests on one side, by way of a ball socket 50, on a valve play equalization element 52 having a corresponding ball end which is mounted in the cylinder head 12 as illustrated. The other end of the component 42 has mounted on it a carrier 53 which operates in conjunction with the end of the shaft of the upper valve 16.

The layout described creates precise valve operation with the valve play equalization element 52 at rest (lower weights in motion).

As is to be seen from FIG. 1 in particular, the inclined adjusting plane 30 viewed as a whole is positioned more or less perpendicular to the direction of adjustment 24 of rocker arm component 18 and the sliding block element 34 acts on the valve rocker 36, its contact surfaces 36*a*,36*b* being oriented parallel to the direction of adjustment 24. The valve rocker 36 is situated more or less beneath the camshaft axis of rotation 1 Oa between the rocker arm component 18, which is adjustable tangentially to the cam 14 and the upper valve 16.

The valve rocker 36 (see FIGS. 3 and 4) or its valve rocker component 40 is positioned, in the situation illustrated in FIGS. 1 and 2 (corresponding to a full stroke), with the upper valve 16 closed, on a stop 54 of the base wall 56 of the rocker arm component 18, the valve rocker 36 being kept free of play by way of the valve play equalization element 52.

In this position the sliding block element 34 has a no-load run s as viewed between the contact surfaces 36*a*,36*b* of the valve rocker 36 and the base circle 14*b* of the cam 14.

This no-load run s results in lifting of the sliding block element 34 from the contact surfaces 36*a*,36*b* of the valve rocker 36, since two clip springs 56 fastened in the rocker arm component 18 pretension the sliding block element 34 under spring tension against the cam 14 by one of their clips 56*a*. As is to be seen from FIG. 2, the clips 56*a* engage the transfer pin 34*d* between central roller 34*a* and the two adjacent rollers 34*b*,34*c*, while their second spring 56*b* rests on the rocker arm component 18.

The sliding block element 34 is thereby preaccelerated first in excitation movement in the area of the no-load run s, this no-load run increasing in proportion as the valve stroke (displacement of the rocker arm component 18 in FIG. 1 of the drawing to the right) decreases.

This excitation movement of the sliding block element 34 increases as a result of the shape of the inclined preacceleration plane 30 until the transfer pin 34*d* is shifted onto inclined starting plane section 30*a* of the inclined adjusting plane 30, this pin 34*d* simultaneously running up by way of the rollers 34*b*,34*c* on the starting surfaces 36*a*,36*b* of the valve rocker 36 and actuating the upper valve 16 in further generation movement. Section 30*a* extends more or less tangentially to the cam 14 or its inclined starting and ending plane.

On the other hand, when the upper valve 16 closes, the valve rocker 36 ultimately reaches the stop 54 and then lifts the sliding block element 34 from the valve rocker 36, within the limits of the no-load run s present precisely at this time.

The geometric configuration of the cam 14 and the inclined adjusting planes 30,32 in the rocker arm component 18 are discussed in detail with reference to the diagrams in FIGS. 5 and 6.

FIG. 5 illustrates the movement curves for a full stroke and FIG. 6 the movement curves for a partial stroke of the upper valve 16. The vertical lines designate the respective valve stroke $s_v$.

Curve a corresponds to the movement of adjustment of the sliding block element 34, the parts of the excitation movement corresponding to the no-load run s of the sliding block element 34. It is to be considered to be essential to this invention that even in the case of a full stroke (FIG. 5) a no-load run s is present which places the starting point of the movement of generation (valve actuation) on the branch between b and c of curve a which corresponds in approximation to uniform valve acceleration.

Curve d describes the geometric configuration of the inclined adjusting plane 30, which in conjunction with the configuration of curve a yields the actual valve lift by way of valve stroke $s_v$ illustrated by curve e. Additional curve f describes the course of valve acceleration, it being noteworthy that the acceleration peaks are more or less the same in full stroke (FIG. 5) and partial stroke (FIG. 6).

Consequently, the valve train described makes possible "full" valve lift curves e for the full stroke of upper valves 16 without elevated acceleration peaks in the case of a partial stroke.

What is claimed is:

1. A variable valve train for internal combustion engines having at least one cam on a camshaft rotatably mounted in a cylinder head for actuating a valve, whereby the cam acts upon a sliding block element movably guided in a rocker arm component along a slotted rocker arm guide, the sliding block element acts upon a valve actuation element, and the valve actuation element acts upon the valve, a stroke of the valve being variably adjustable by a linear displacement of the rocker arm component, and the sliding block element is pretensioned against the cam by a spring, wherein provided between a cam base circle of the cam and the valve actuation element is an inclined preacceleration plane portion of the slotted rocker arm guide permitting an excitation movement of the sliding block element without actuating the valve actuation element in an area of a free travel and during said excitation movement, the sliding block element is raised above said valve actuation element.

2. The valve train as specified in claim 1, wherein the excitation movement of the sliding block element corresponds to an initial acceleration and final deceleration of a profile of the cam.

3. The valve train as specified in claim 1, wherein the slotted rocker arm guide is oriented substantially perpendicular to the linear displacement of the rocker arm component and wherein the valve actuation element is a valve rocker mounted in the cylinder head on one side below the cam shaft between the rocker arm component and a shaft end of the valve.

4. The valve train as specified in claim 3, wherein the slotted rocker arm guide has an inclined starting ramp portion extending along a plane substantially parallel to a plane tangential to the cam.

5. The valve train as specified in claim 4, wherein contact surfaces on the valve rocker for contact with the sliding block element are parallel to the direction of the linear displacement.

6. The valve train as specified in claim 5, wherein the slotted rocker arm guide is formed on opposite inside surfaces of the rocker arm component and forms the preacceleration plane for the excitation movement.

7. The valve train as specified in claim 6, wherein the sliding block element is pretensioned against the cam by means of at least one spring clip.

8. The valve train as specified in claim 7, wherein the at least one spring clip is mounted directly on the rocker arm component.

9. The valve train as specified in claim 8, wherein the valve rocker abuts a stop portion of the rocker arm component when the valve is in a closed position.

10. The valve train as specified in claim 9, wherein the rocker arm component has fitting bores that interact with guide pins fastened on the cylinder head to allow for the linear displacement of the rocker arm component.

11. The valve train as specified in claim 10, wherein the valve rocker is pivotally mounted to the cylinder head using at least one valve rocker shaft.

12. The valve train as specified in claim 1, wherein the valve actuation element is a valve rocker having at least two parts, a first valve rocker component pivotally mounted to the cylinder head via a valve rocker shaft and having contact surfaces that contact the sliding block element; and a second valve rocker component extending parallel to the first valve rocker element and on a first side pivotally mounted to a hydraulic valve play equalization element and on a second side, engaging a shaft of the valve.

13. The valve train as specified in claim 12, wherein the first valve rocker component is H-shaped, having two elongated sections containing the contact surfaces extending parallel to each other and a carrier extending transversely to the two sections and engaging the second valve rocker element, and wherein the second valve rocker component extends between the two sections.

14. The valve train as specified in claim 1, wherein the slotted rocker arm guide has an inclined starting ramp portion extending along a plane substantially parallel to a plane tangential to the cam.

15. The valve train as specified in claim 1, wherein the sliding block element is pretensioned against the cam by means of at least one spring clip.

16. The valve train as specified in claim 15, wherein the at least one spring clip is mounted directly on the rocker arm component.

17. The valve train as specified in claim 1, wherein the valve actuation element abuts a stop portion of the rocker arm component when the valve is in a closed position.

18. The valve train as specified in claim 1, wherein the rocker arm component has fitting bores that interact with guide pins fastened on the cylinder head to allow for the linear displacement of the rocker arm component.

19. The valve train as specified in claim 1, wherein the valve actuation element is pivotally mounted to the cylinder head using at least one valve rocker shaft.

20. A variable valve train for internal combustion engines having at least one cam on a camshaft rotatably mounted in a cylinder head for actuating a valve, whereby the cam acts upon a sliding block element movably guided in a rocker arm component along a slotted rocker arm guide formed on opposite inside surfaces of the rocker arm component, the sliding block element acts upon a valve actuation element, and the valve actuation element acts upon the valve, a stroke of the valve being variably adjustable by a linear displacement of the rocker arm component, and the sliding block element is pretensioned against the cam by a spring, wherein provided between a cam base circle of the cam and the valve actuation element is an inclined preacceleration plane portion of the slotted rocker arm guide permitting an excitation movement of the sliding block element without actuating the valve actuation element in an area of a free travel and during said excitation movement, the sliding block element is raised above said valve actuation element.

* * * * *

UNITED STATES PATENT AND TRADEMARK OFFICE

CERTIFICATE OF CORRECTION

PATENT NO. : 6,715,456 B2
DATED : April 6, 2004
INVENTOR(S) : Wurms et al.

It is certified that error appears in the above-identified patent and that said Letters Patent is hereby corrected as shown below:

Delete the entire specification from Column 1, line 1 to Column 4, line 42, and insert the attached substitute specification.

Signed and Sealed this

Ninth Day of May, 2006

JON W. DUDAS
*Director of the United States Patent and Trademark Office*

VARIABLE VALVE CONTROL COMPRISING A SLIDING-BLOCK PART AND A FREE TRAVEL

The invention relates to a variable valve control device for reciprocating engines, internal combustion engines in particular.

BACKGROUND OF THE INVENTION

Such a variable valve control device is disclosed, for example, in DE 42 23 173 A1; it is a device in which an adjustable sliding block (rocker arm) element in the cylinder head of the internal combustion engine, with an inclined adjusting plane and a roller, is introduced between the cam of a camshaft on one side and the cup stem on the shaft end of an upper valve on the other side. Both a full stroke and partial strokes to around zero stroke can be controlled by displacement of the sliding block element relative to the cam. In the case of a full stroke such displacement results in valve actuation which with respect to valve lift and velocity profile development is determined by the geometry of the cam and the inclined adjusting plane and which may be correspondingly optimized. In the case of the partial stroke, of course, first an idle stroke (=excitation movement) is executed and then the partial stroke (=generation movement), a cam area exerting its effect later in time in this instance, an area which of necessity may cause a different velocity profile development or high, jerky valve accelerations. This applies both to valve opening (upward slope) and valve closing (downward slope).

SUMMARY OF THE INVENTION

The object of the invention is to create a generic variable valve control device which permits extensive valve stroke changes accompanied by valve actuation as free of jerkiness as possible and which is of rugged design and cost-effective in manufacture.

It is claimed for the invention that this object is attained by the features specified in the independent claim. Advantageous developments of the invention are specified in the additional dependent claims.

It is proposed in accordance with the invention that there be inserted between the cam and the valve actuation element, a valve rocker in particular, an empty run (free travel) component which effects preacceleration (excitation movement) of the sliding block in the case both of a full stroke and partial strokes of the upper valve, so that the generation movement (opening movement) of the upper valve is controlled with the positive and negative acceleration desired essentially by the inclined adjusting plane of the rocker arm element. This decoupling of excitation movement and generation movement executed by the geometric design of cam and variable valve control device creates a velocity profile without higher acceleration peaks and accordingly a rugged valve train which is improved from the viewpoint of wear and operating noise, to the greatest extent possible independently of the assigned valve travel.

The layout of the valve train additionally permits longer valve strokes and accordingly a larger valve stroke adjustment range determined by a valve rocker having the associated more favorable rocker ratios and by the positioning of the inclined adjusting plane more or less perpendicular to the axis of rotation of the cam, which results in shorter lateral travel distances of the roll pack especially during excitation movement. In this situation the contact surface of the valve rocker for the roll pack may be oriented parallel to the direction of displacement of the rocker arm element.

In another advantageous embodiment of the invention the inclined adjusting plane of the rocker arm element is in the form of a slotted rocker arm guide whose opposite guide surface forms an inclined preacceleration plane in excitation movement of the sliding block element which provides smooth transition to the inclined contact plane section of the inclined adjusting plane for the movement of generation. This results in gentle sliding positioning of the sliding block element on the valve rocker followed by generation movement without a transitional element.

The sliding block element may advantageously be pretensioned against the cam by means of at least one simple spring clip. The spring clip may preferably be supported on the rocker arm element by one of its sides and acts in conjunction with a second, elongated side on the sliding block element pretensioning the latter against the cam.

In the case of use of a hydraulic valve play equalization element in the valve train in particular it may be advantageous for the valve rocker to rest against a stop of the rocker arm component when the upper valve is in the closed position. The pulley assembly may be lifted by the valve rocker as a result of pretensioning of the spring clip, so that constant contact is established between the sliding block element and the cam, and free play is established between the valve rocker, the rocker arm element, and the valve shaft.

In order to achieve a valve rocker structure which is rigid and produces high layout accuracy, preference is given to mounting the valve rocker in the cylinder head by way of one valve rocker axis. In this situation the hydraulic valve play equalization element could then be mounted on the end of the valve rocker operating in conjunction with the shaft end of the upper valve. It is proposed, however, that preference be given to a valve rocker in at least two parts, one part of which is pivotably mounted, while the other part resembling a rocker rests on one side on the hydraulic valve play equalization element and on the other on the shaft end of the upper valve, the two interposed valve rocker parts being connected to each other in operation (by means of a carrier extending transversely or by a pin joint connection).

BRIEF DESCRIPTION OF THE DRAWINGS

One exemplary embodiment of the invention is explained in greater detail in what follows. The drawings illustrate.

DETAILED DESCRIPTION OF A PREFERRED EMBODIMENT

Figure 1:
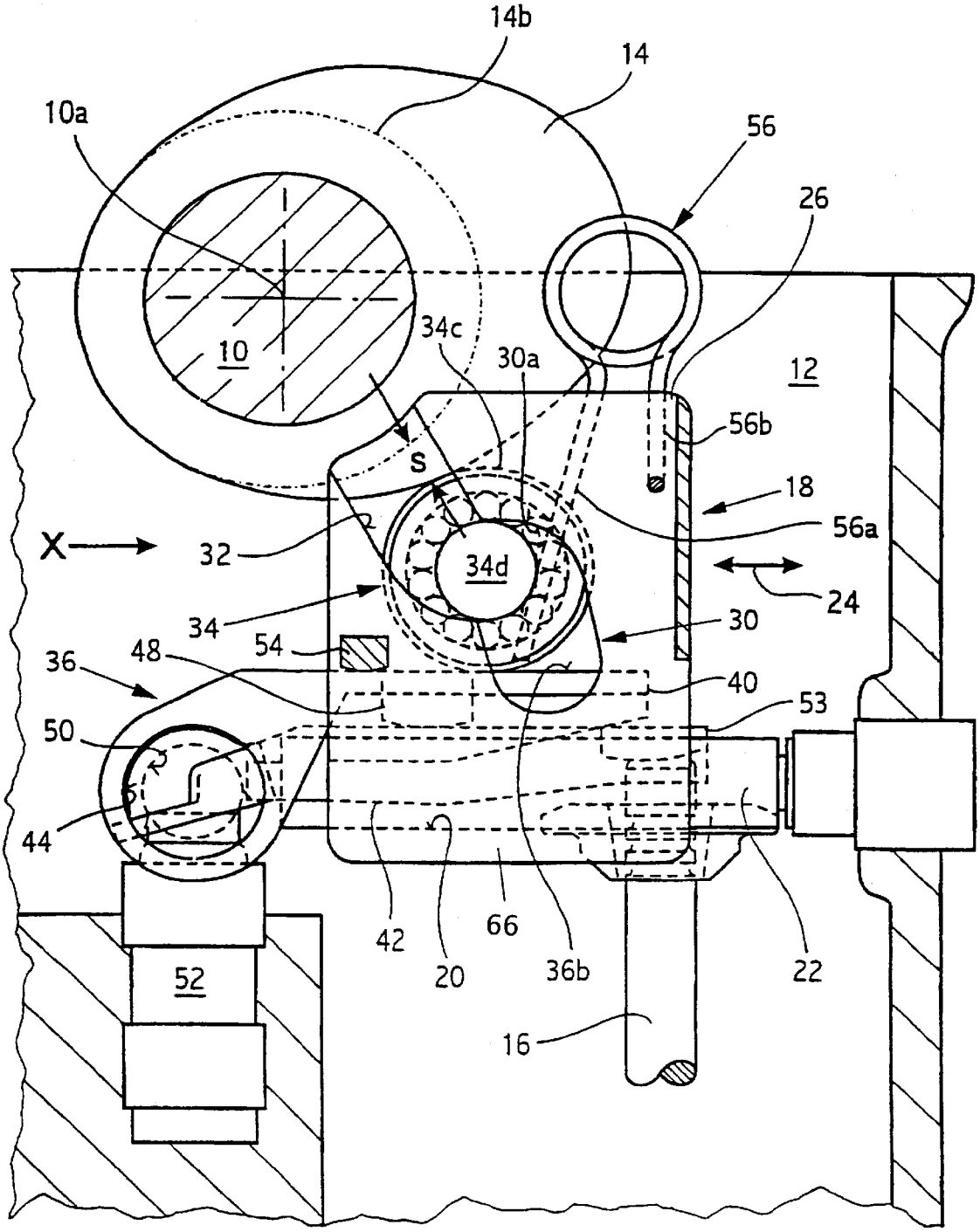
in FIG. 1 a cross-section through a variable valve train in the cylinder head of a reciprocating internal combustion engine along line I—I of FIG. 2, with a cam, a movable rocker arm element, a sliding block element, and a valve rocker acting on an upper valve.
Figure 2:
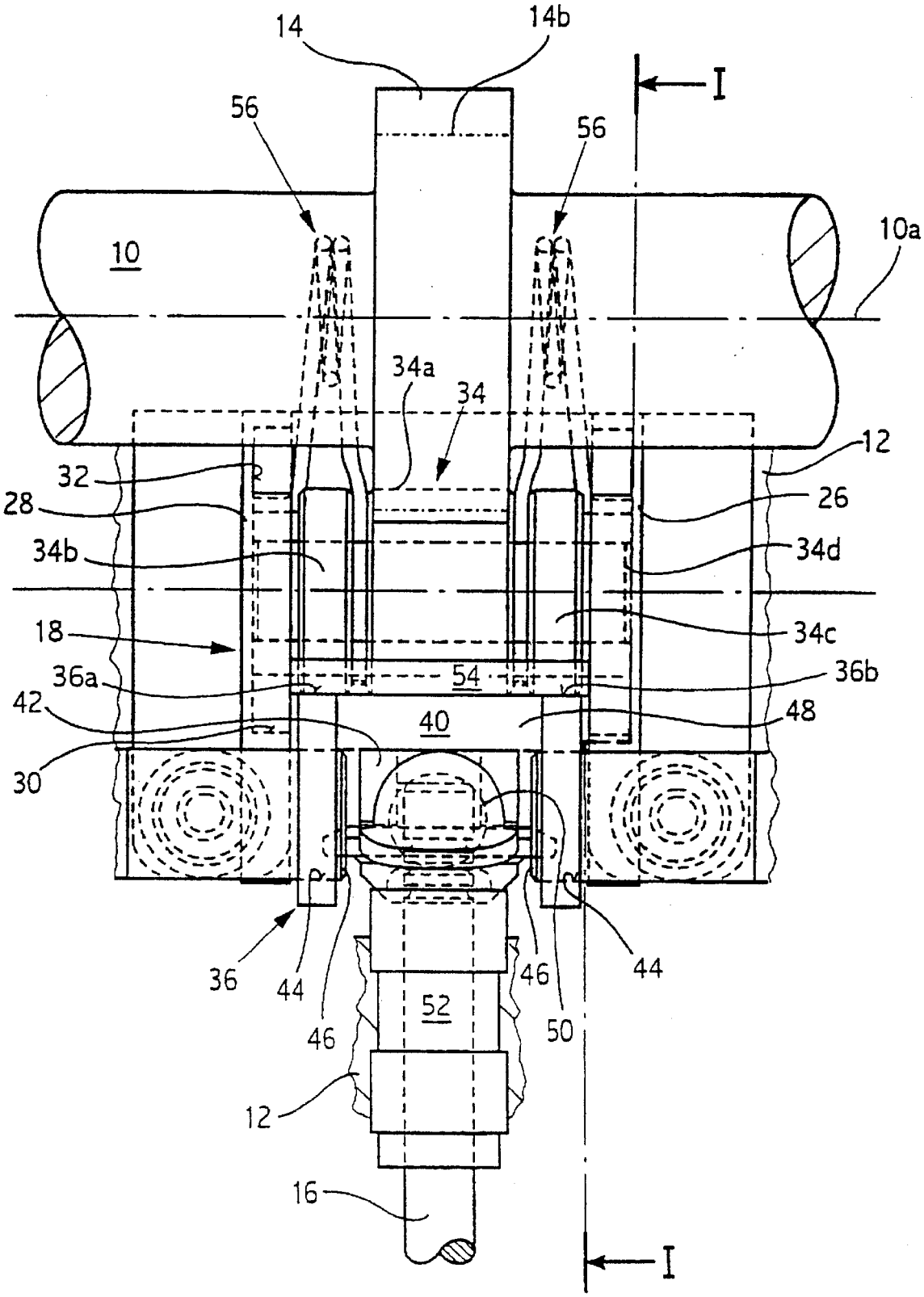
in FIG. 2 a view of the valve train along arrow X in FIG. 1.

In FIGS. 1 and 2, 10 designates a camshaft which is rotatably mounted in a cylinder head 12 (only part of which is shown) of a multiple-cylinder reciprocating internal combustion engine and which carries a cam 14 for actuation of intake upper valves, only one upper valve or its vertical shaft 16 being shown.

In order to obtain a variable valve train, a rocker arm component 18 is movably mounted by way of fitting bores (20) in the cylinder head 12 on stationary guide pins 22. The rocker arm component 18, may be adjusted in the direction of the double arrow 24 by means of an adjusting mechanism not shown (such as an eccentric shaft adjusted by hydraulic or electric means).

The more or less U-shaped rocker arm component 18 with a base wall 66 has in each of the lateral legs 26,28 a rocker arm guide with an inclined adjusting plane 30 and an inclined preacceleration plane 32, forming a slotted rocker arm guide.

A sliding block element 34 is inserted so as to be movable into the slotted rocker arm guide open at the top of the rocker arm component. The sliding block element 34 has a central roller **34*a* (FIG. 2) which rolls on the cam 14. To the left and right of this element 34 two other rollers 34*b*, 34*c* are provided which roll on the contact surfaces 36*a*, 36*b* of a valve rocker 36, the rollers in question being mounted on roller bearings on a transfer pin 34*d*** which operates in conjunction with the slotted rocker arm guide in question.

The valve rocker 36 is made up of a first H-shaped valve rocker component 40 and an interposed valve rocker component 42 which are mounted as follows.

The first valve rocker component 40 is one side mounted by way of mounting bores 44 on stationary valve rocker shafts 46 and carries the contact surfaces **36*a*, 36*b* for the rollers 34*b*, 34*c* of the sliding block element 34. In addition, the valve rocker component 40 has a carrier 48 extending transversely which acts on the interposed second valve rocker component 42** as a counterpoise.

The second valve rocker component 42 rests on one side, by way of a ball socket 50, on a valve play equalization element 52 having a corresponding ball end which is mounted in the cylinder head 12 as illustrated. The other end of the component 42 has mounted on it a carrier 53 which operates in conjunction with the end of the shaft of the upper valve 16.

The layout described creates precise valve operation with the valve play equalization element 52 at rest (lower weights in motion).

As is to be seen from FIG. 1 in particular, the inclined adjusting plane 30 viewed as a whole is positioned more or less perpendicular to the direction of adjustment 24 of rocker arm component 18 and the sliding block element 34 acts on the valve rocker 36, its contact surfaces **36*a*, 36*b* being oriented parallel to the direction of adjustment 24. The valve rocker 36 is situated more or less beneath the camshaft axis of rotation 10*a* between the rocker arm component 18, which is adjustable tangentially to the cam 14 and the upper valve 16**.

Figure 3:
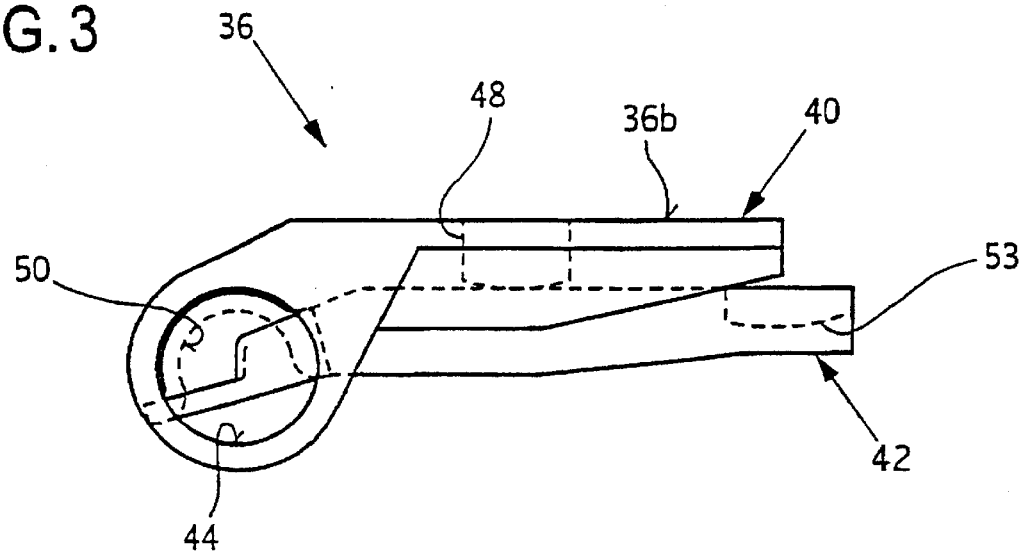
in FIG. 3 a side view of the two-part valve rocker mounted between the rocker arm element and the upper valve.
Figure 4:
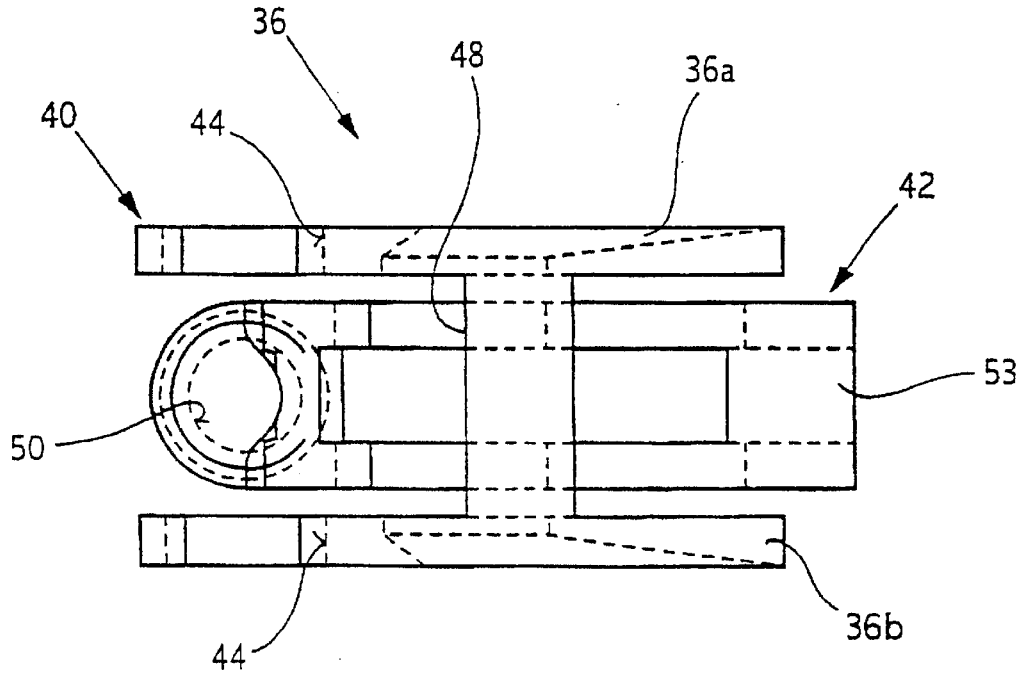
in FIG. 4 a top view of the valve rocker shown in FIG. 3.

The valve rocker 36 (see FIGS. 3 and 4) or its valve rocker component 40 is positioned, in the situation illustrated in FIGS. 1 and 2 (corresponding to a full stroke), with the upper valve 16 closed, on a stop 54 of the base wall 56 of the rocker arm component 18, the valve rocker 36 being kept free of play by way of the valve play equalization element 52.

In this position the sliding block element 34 has a no-load run s as viewed between the contact surfaces **36*a*, 36*b* of the valve rocker 36 and the base circle 14*b* of the cam 14**.

This no-load run s results in lifting of the sliding block element 34 from the contact surfaces **36*a*, 36*b* of the valve rocker 36, since two clip springs 56 fastened in the rocker arm component 18 pretension the sliding block element 34 under spring tension against the cam 14 by a first clip spring section 56*a* of each spring clip 56. As is to be seen from FIG. 2, the first clip spring sections 56*a* engage the transfer pin 34*d* between central roller 34*a* and the two adjacent rollers 34*b*, 34*c*, while second clip spring sections 56*b* rest on the rocker arm component 18**.

The sliding block element 34 is thereby preaccelerated first in excitation movement in the area of the no-load run s, this no-load run increasing in proportion as the valve stroke (displacement of the rocker arm component 18 in FIG. 1 of the drawing to the right) decreases.

This excitation movement of the sliding block element 34 increases as a result of the shape of the inclined preacceleration plane 32 until the transfer pin **34*d* is shifted onto inclined starting plane section 30*a* of the inclined adjusting plane 30, this pin 34*d* simultaneously running up by way of the rollers 34*b*, 34*c* on the starting surfaces 36*a*, 36*b* of the valve rocker 36 and actuating the upper valve 16 in further generation movement. Section 30*a* extends more or less tangentially to the cam 14** or its inclined starting and ending plane.

On the other hand, when the upper valve 16 closes, the valve rocker 36 ultimately reaches the stop 54 and then lifts the sliding block element 34 from the valve rocker 36, within the limits of the no-load run s present precisely at this time.

The geometric configuration of the cam 14 and the slotted rocker arm guide in the rocker arm component 18 are discussed in detail with reference to the diagrams in FIGS. 5 and 6.

Figure 6:
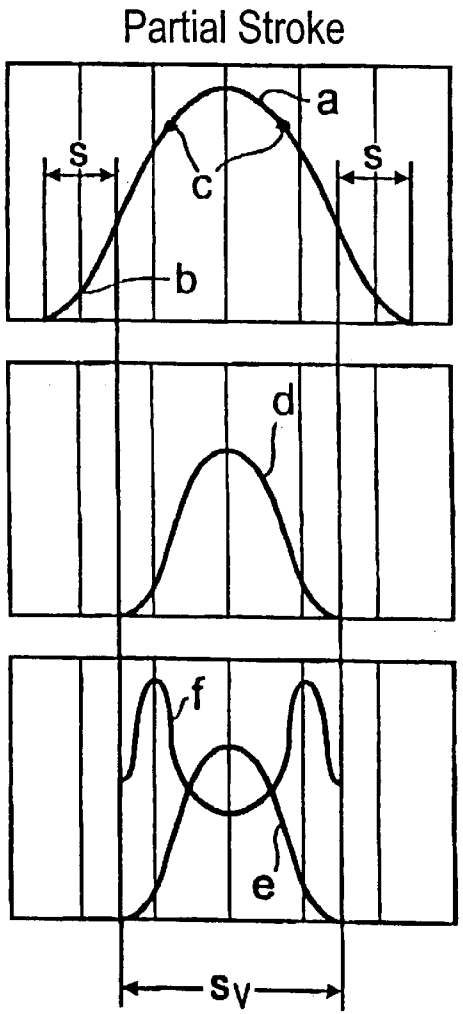
Figure 5:
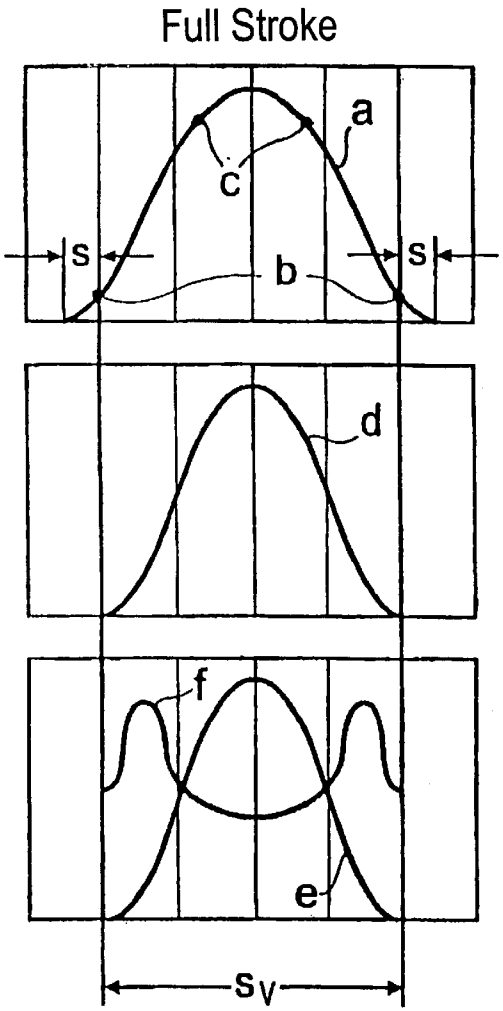
in FIG. 5 diagrams of the valve train in the case of a full stroke; and in FIG. 6 the same diagrams for a partial stroke of the upper valve.

FIG. 5 illustrates the movement curves for a full stroke and FIG. 6 the movement curves for a partial stroke of the upper valve 16. The vertical lines designate the respective valve stroke $s_v$.

Curve a corresponds to the movement of adjustment of the sliding block element 34, the parts of the excitation movement corresponding to the no-load run s of the sliding block element 34. It is to be considered to be essential to this invention that even in the case of a full stroke (FIG. 5) a no-load run s is present which places the starting point of the movement of generation (valve actuation) on the branch between b and c of curve a which corresponds in approximation to uniform valve acceleration.

Curve d describes the geometric configuration of the inclined adjusting plane 30, which in conjunction with the configuration of curve a yields the actual valve lift by way of valve stroke $s_v$ illustrated by curve e. Additional curve f describes the course of valve acceleration, it being noteworthy that the acceleration peaks are more or less the same in full stroke (FIG. 5) and partial stroke (FIG. 6).

Consequently, the valve train described makes possible "full" valve lift curves e for the full stroke of upper valves 16 without elevated acceleration peaks in the case of a partial stroke.

The invention claimed is:

1. A variable valve train for internal combustion engines having at least one cam on a camshaft rotatably mounted in a cylinder head for actuating a valve, whereby the cam acts upon a sliding block element movably guided in a rocker arm component along a slotted rocker arm guide, the sliding block element acts upon a valve actuation element, and the valve actuation element acts upon the valve, a stroke of the valve being variably adjustable by a linear displacement of the rocker arm component, and the sliding block element is pretensioned against the cam by a spring, wherein provided between a cam base circle of the cam and the valve actuation element is an inclined preacceleration plane portion of the slotted rocker arm guide permitting an excitation movement of the sliding block element without actuating the valve actuation element in an area of a free travel and during said excitation movement, the sliding block element is raised above said valve actuation element.

2. The valve train as specified in claim 1, wherein the excitation movement of the sliding block element corresponds to an initial acceleration and final deceleration of a profile of the cam.

3. The valve train as specified in claim 1, wherein the slotted rocker arm guide is oriented substantially perpendicular to the linear displacement of the rocker arm component and wherein the valve actuation element is a valve rocker mounted in the cylinder head on one side below the cam shaft between the rocker arm component and a shaft end of the valve.

4. The valve train as specified in claim 3, wherein the slotted rocker arm guide has an inclined starting ramp portion extending along a plane substantially parallel to a plane tangential to the cam.

5. The valve train as specified in claim 4, wherein contact surfaces on the valve rocker for contact with the sliding block element are parallel to the direction of the linear displacement.

6. The valve train as specified in claim 5, wherein the slotted rocker arm guide is formed on opposite inside surfaces of the rocker arm component and forms the preacceleration plane for the excitation movement.

7. The valve train as specified in claim 6, wherein the sliding block element is pretensioned against the cam by means of at least one spring clip.

8. The valve train as specified in claim 7, wherein the at least one spring clip is mounted directly on the rocker arm component.

9. The valve train as specified in claim 8, wherein the valve rocker abuts a stop portion of the rocker arm component when the valve is in a closed position.

10. The valve train as specified in claim 9, wherein the rocker arm component has fitting bores that interact with guide pins fastened on the cylinder head to allow for the linear displacement of the rocker arm component.

11. The valve train as specified in claim 10, wherein the valve rocker is pivotally mounted to the cylinder head using at least one valve rocker shaft.

12. The valve train as specified in claim 1, wherein the valve actuation element is a valve rocker having at least two parts, a first valve rocker component pivotally mounted to the cylinder head via a valve rocker shaft and having contact surfaces that contact the sliding block element; and a second valve rocker component extending parallel to the first valve rocker element and on a first side pivotally mounted to a hydraulic valve play equalization element and on a second side, engaging a shaft of the valve.

13. The valve train as specified in claim 12, wherein the first valve rocker component is H-shaped, having two elongated sections containing the contact surfaces extending parallel to each other and a carrier extending transversely to the two sections and engaging the second valve rocker element, and wherein the second valve rocker component extends between the two sections.

14. The valve train as specified in claim 1, wherein the slotted rocker arm guide has an inclined starting ramp portion extending along a plane substantially parallel to a plane tangential to the cam.

15. The valve train as specified in claim 1, wherein the sliding block element is pretensioned against the cam by means of at least one spring clip.

16. The valve train as specified in claim 15, wherein the at least one spring clip is mounted directly on the rocker arm component.

17. The valve train as specified in claim 1, wherein the valve actuation element abuts a stop portion of the rocker arm component when the valve is in a closed position.

18. The valve train as specified in claim 1, wherein the rocker arm component has fitting bores that interact with guide pins fastened on the cylinder head to allow for the linear displacement of the rocker arm component.

19. The valve train as specified in claim 1, wherein the valve actuation element is pivotally mounted to the cylinder head using at least one valve rocker shaft.

20. A variable valve train for internal combustion engines having at least one cam on a camshaft rotatably mounted in a cylinder head for actuating a valve, whereby the cam acts upon a sliding block element movably guided in a rocker arm component along a slotted rocker arm guide formed on opposite inside surfaces of the rocker arm component, the sliding block element acts upon a valve actuation element, and the valve actuation element acts upon the valve, a stroke of the valve being variably adjustable by a linear displacement of the rocker arm component, and the sliding block element is pretensioned against the cam by a spring, wherein provided between a cam base circle of the cam and the valve actuation element is an inclined preacceleration plane portion of the slotted rocker arm guide permitting an excitation movement of the sliding block element without actuating the valve actuation element in an area of a free travel and during said excitation movement, the sliding block element is raised above said valve actuation element.

* * * * *